US008424477B2

(12) United States Patent
Burandt

(10) Patent No.: US 8,424,477 B2
(45) Date of Patent: Apr. 23, 2013

(54) SAILING DEVICE FOR DEEP-SEA VESSELS

(76) Inventor: Burghardt Burandt, München (DE)

( * ) Notice: Subject to any disclaimer, the term of this patent is extended or adjusted under 35 U.S.C. 154(b) by 104 days.

(21) Appl. No.: 13/055,817

(22) PCT Filed: Jul. 13, 2009

(86) PCT No.: PCT/EP2009/005082
§ 371 (c)(1),
(2), (4) Date: Feb. 23, 2011

(87) PCT Pub. No.: WO2010/012373
PCT Pub. Date: Feb. 4, 2010

(65) Prior Publication Data

US 2011/0139052 A1 Jun. 16, 2011

(30) Foreign Application Priority Data

Jul. 28, 2008 (DE) ..... 10 2008 035 071

(51) Int. Cl.
*B63B 9/04* (2006.01)

(52) U.S. Cl.
USPC ..... 114/102.1; 114/102.16

(58) Field of Classification Search ..... 114/102.1, 114/102.16, 102.22
See application file for complete search history.

(56) References Cited

U.S. PATENT DOCUMENTS

| | | | | |
|---|---|---|---|---|
| 4,465,008 | A * | 8/1984 | Liggett | 114/39.28 |
| 4,685,410 | A * | 8/1987 | Fuller | 114/39.31 |
| 4,867,089 | A * | 9/1989 | Haigis | 114/39.32 |
| 5,197,401 | A * | 3/1993 | Finley et al. | 114/102.16 |
| 6,431,100 | B2 * | 8/2002 | Abshier | 114/102.1 |

FOREIGN PATENT DOCUMENTS

| | | |
|---|---|---|
| DE | 7732111 | 4/1978 |
| EP | 0173979 | 3/1986 |
| GB | 742128 | 12/1955 |
| GB | 2234723 | 2/1991 |
| WO | 8402319 | 6/1984 |

* cited by examiner

*Primary Examiner* — Stephen Avila
(74) *Attorney, Agent, or Firm* — Robert Curcio, Esq.; DeLio & Peterson, LLC

(57) ABSTRACT

A sailing device for efficient uses of wind energy which use at least one mast connected to the ship and two sail areas which are attached to the mast. The at least one mast is fitted with a top holder at the upper end facing away from the ship as well as a bottom holder at the lower end that is connected to the ship in order to maintain and adjust the sail areas, and ends of the sail areas are guided within the holders, adjustable in the longitudinal or transverse direction.

17 Claims, 3 Drawing Sheets

SAILING DEVICE FOR DEEP-SEA VESSELS

This application is a National Stage filing based on PCT/EP2009/005082, filed Jul. 13, 2009, and which claims priority to German Patent Application No. DE 2008 035 071.0, filed Jul. 28, 2008.

BACKGROUND OF THE INVENTION

1. Field of the Invention

The invention relates to a sail system in particular for ocean-going cargo ships, yachts, or the like.

2. Description of Related Art

From the media (see for example the article "Wie Tanker Kraftstoff sparen kann" [How tankers can save fuel] in the newspaper Welt am Sonntag, no. 5 of 3 Feb. 2008) people are familiar with calls for cruise ships and container ships to emit fewer pollutants in the future than they have up till now and for them to do their bit to save energy in the form of fossil fuels. Certain operators of vessels of this kind are having recourse to wind power as an additional means of propulsion and are making use of, for example, paragliders, airships or sails, which are able to assist the forward movement of the vessel and hence to make a contribution to the reduced emission of pollutants and to the saving of energy. Also, in the article "Betriebssimulation von Frachtschiffen mit Windzusatz-antrieb" [Simulation of the operation of wind-assisted cargo ships] by Clauss et al., 102. Hauptversammlung der Schiffbautechnischen Gesellschaft, 21 to 23.11.2007, Berlin, pages 1 to 11, there is a description of various types of sails which are compared with one another. There is mention here of what is referred to as a BSP sail which comprises modified flap profiles of the kind which are known from aeronautical engineering and jet engines. With the majority of such means of propulsion, some of which are new developments, it is difficult or even totally impossible to sail close to the wind and, this being the case, to sail close-hauled to more than an inadequate extent, or indeed at all. This means that the operators of such vessels have to keep very largely to historical seasonal sailing routes, and sometimes have to accept the need for considerable diversions. Diversions of this kind often negate the technical and environmental advantages of the additional means of propulsion.

Known from document DE 77 32 111 U1 is a sail system in which six expanses of sail arranged one behind the other are connected to a mast by means of an upper and a lower mounting which each extend horizontally. The expanses of sail are each able to rotate on an approximately vertical axis.

Known from GB 2 234 723 A is a sail system in which a mast which is U-shaped and hence of a goalpost-like form has an upper and a lower mounting. Between the mountings there are three expanses of sail which are able to be pivoted on approximately vertical rotating shafts which are fastened to the mountings.

Known from GB 742,128 A is a sailing device in which the upper ends of both expanses of sail, which ends taper to a point, are guided directly on the mast whereas the lower, forward, ends of the expanses of sail are adjustably guided in the longitudinal direction of the vessel on a mounting.

BRIEF SUMMARY OF THE INVENTION

The object underlying the invention is to provide a sail system that makes it possible to sail close to the wind and enables efficient use to be made of the energy of the wind.

The above and other objects, which will be apparent to those skilled in the art, are achieved in the present invention, which is directed to a sail system for a deep-sea vessel comprising at least one mast which is connected to the vessel, and including two expanses of sail held by the at least one mast, the at least one mast including an upper mounting at its upper end pointing away from the vessel, and a lower mounting at its lower end connected to the vessel, to enable the expanses of sail to be held and set, and ends of the expanses of sail adjustably guided in the mountings in the longitudinal and transverse directions of the vessel. The mountings may include a cruciform shape and a support extending in the longitudinal direction of the vessel and a support extending in the transverse direction of the vessel, to guide the ends of the expanses of sail. Each longitudinal support may include a bow and a stern portion and each transverse support includes a port and a starboard portion, to receive respective ends of one of the expanses of sail.

The sail system may further include having a forward end of one expanse of sail fastened to the longitudinal supports of the mountings and an aft end of this one expanse of sail fastened to the transverse supports thereof, and a forward end of the other expanse of sail fastened to the transverse supports of the mountings and an aft end of this other expanse of sail fastening to the longitudinal supports thereof, adjustable independently of one another, and each end of the expanses of sail positionable separately from the others on the upper and lower mountings.

The mountings, or the mast plus the mountings, may be rotatable, and may be turnable relative to one another.

The longitudinal and transverse supports of the mountings may include rails in profile form and each longitudinal and transverse support may include two rails in profile form extending approximately parallel to one another, both of which extend for the entire length of the longitudinal and transverse supports. The expanses of sail may form rectangular or trapezoidal sails arranged parallel to the mast.

The sail system may further include a microprocessor for controlling the setting and adjustment of the expanses of sail.

BRIEF DESCRIPTION OF THE DRAWINGS

Embodiments of the item to which the invention relates will be explained in detail in what follows by reference to the drawings, all the features which are described and/or shown in pictorial form being, in themselves or in any desired combination, part of item to which the present invention relates regardless of how they are grouped together in the claims or by the back-references in the claims. In the drawings:

FIG. 1 is a schematic perspective view of a sail system in particular for ocean-going cargo ships, yachts or the like.

DETAILED DESCRIPTION OF THE INVENTION

Figure 1:
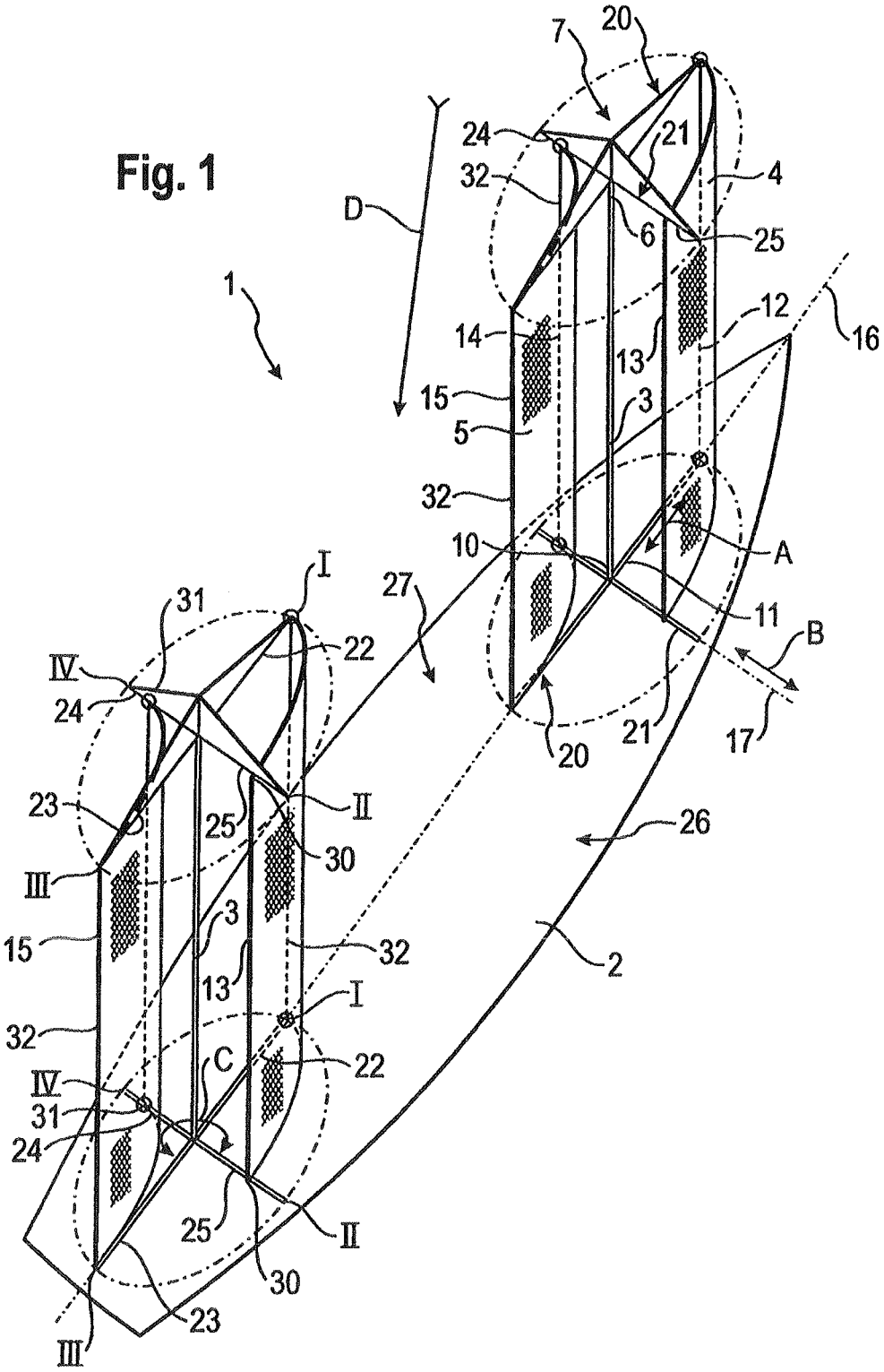

In describing the preferred embodiment of the present invention, reference will be made herein to FIGS. 1-7 of the drawings in which like numerals refer to like features of the invention.

The sail system according to the invention has at least one mast which is connected to the vessel and two expanses of sail which are held by means of the mast, wherein the mast has, to enable the expanses of sail to be held and set, an upper mounting at its upper end pointing away from the vessel and a lower mounting at its lower end connected to the vessel, and ends of the expanses of sail are adjustably guided in the mountings in the longitudinal and transverse directions of the vessel. The arrangement of mast and mountings gives an extremely compact sail system which requires only a relatively small amount of space. The sail system according to the invention in the form of the mast having an upper and lower mounting is able to carry a greater area of sail than is the case with conventional mast/sail structures. In accordance with the invention, a conventional triangular foresail can be dispensed with. Sailing maneuvers which have to be carried out can be accomplished safely and without any problems by means of the adjustable guidance in the longitudinal and transverse directions of the vessel which the ends of the expanses of sail have in the mountings. Because of their arrangement within the sail system, the two expanses of sail are able to help to increase the performance of the sail system as a whole as a result of what is known as a venturi effect. The sail system according to the invention makes it possible both to sail very close to the wind and for optimum progress to be made when on a broad reach.

In a refinement of the invention, the mountings are each cruciform in shape and have, to guide the ends of the expanses of sail, a support which extends in the longitudinal direction of the vessel and a support which extends in the transverse direction of the vessel, each longitudinal support having a bow and a stern portion and each transverse support having a port and a starboard portion, to receive respective ends of one of the expanses of sail. Mountings and supports of this kind have to be designed and hence sized on a safe basis and can be made of materials which are of high strength but at the same time light. Navigation with the sail system according to the invention is possible without any problems because each portion of the said longitudinal and transverse supports is associated with only one end of an expanse of sail. Hence, when there are the two expanses of sail mentioned, all four portions of the supports each have an individual end of an expanse of sail applied to them.

In a preferred refinement of the invention, the forward end of one expanse of sail is fastened to the longitudinal supports of the mountings and the aft end of this one expanse of sail is fastened to the transverse supports thereof, and the forward end of the other expanse of sail is fastened to the transverse supports of the mountings and the aft end of this other expanse of sail is fastening to the longitudinal supports thereof, preferably to be adjustable independently of one another, and each end of the expanses of sail is preferably able to be positioned separately from the others at the upper and lower mountings. The said one expanse of sail is preferably the forward expanse of sail in the direction of travel and the said other expanse of sail is preferably the aft expanse of sail in the direction of travel. Hence, the forward end and the aft end of each expanse of sail are adjustable independently of one another and the sail system according to the invention thus enables the expanses of sail to be positioned in the optimum way to suit the prevailing wind conditions. To enable the expanse of sail, and in particular the rear end of the expanse of sail, to be positioned in the optimum way over its height, the rear of the expanse of sail can be adjusted or displaced at the top and bottom respectively not only in the same way but also, to a limited degree, in different ways. It is possible in this way to obtain a twist in the expanse of sail without the mast structure being twisted.

In another embodiment of the invention, the mountings, and preferably the mast plus the mountings it has, are rotatable, in which case the mountings may also be designed to turn relative to one another. A different position of the sail system according to the invention can thus easily be obtained, when tacking for example, by rotating the mountings or the mast plus the mountings it has through ninety degrees (90°). In this embodiment, the given end of the expanse of sail remains guided on and fastened to its particular portion. On the other hand, this refinement also has the advantage that, if the mountings are turned relative to one another, desired opening effects, also known as twists, can be obtained. The turning of the mountings relative to one another may be up to approximately plus or minus ten degrees (±10°).

The longitudinal and transverse supports of the mountings are advantageously rails in profile form and each longitudinal and transverse support preferably has two rails in profile form extending approximately parallel to one another, both of which extend for the full length of the longitudinal or transverse support, i.e., over both the bow and stern portions of the longitudinal supports and over both the port and starboard portions of the transverse support. This refinement has the advantage that, at the time of sailing maneuvers, the mountings or the mast plus the mountings it has do not have to be rotated in the way that was mentioned above in connection with another refinement of the invention. Instead, the aft end of the one, forward, expanse of sail and the forward end of the other, aft, expanse of sail can be transferred from the port portion of the transverse support to the starboard portion thereof and vice versa. In so doing, the aft end of the forward expanse of sail is, if required, conveyed around the mast to the other side in front of the forward end of the aft expanse of sail. Very much the same can be said for the forward end of the forward expanse of sail and the aft end of the aft expanse of sail which, in the longitudinal direction, are conveyed to whichever is the other side, in the present case from the bow to the stern portion and vice versa, past one another. In another refinement of the invention this may also be done by means of only one profiled rail of the longitudinal or transverse support, as the case may be, to which the ends are however held in different ways and are so fastened that each end can be transferred from one portion to the other and vice versa.

In another refinement of the invention, the expanses of sail take the form of rectangular or trapezoidal sails which are preferably arranged vertically, i.e., parallel to the mast. Particularly large sail expanses can be obtained in this way in a confined space. It is also possible in this way for even more efficient use to be made of the energy of the wind with the sail system according to the invention.

In another refinement of the invention, the setting and adjustment of the expanses of sail is microprocessor controlled. The sail system according to the invention can thus be operated easily and, in the final analysis, single-handedly. This refinement contributes to the economical operation of such a vessel because, as the bottom line, fewer personnel are required to operate the vessel. Also, the energy of the wind can be used even more efficiently with control of this kind because it is possible to react to even quite small changes in, for example, the direction of the wind or the course which is being followed by positioning the expanses of sail quickly in a suitably adapted way.

A sail system 1 particularly for ocean-going cargo ships 2, yachts, or the like, is shown schematically in a perspective view in FIG. 1. The cargo ship or vessel 2 is only schematically indicated.

The sail system 1 has at least one mast 3 which is connected to the vessel 2. The sail system 1 also has two expanses of sail 4, 5 which are held by means of the mast 3. The expanse of sail 4 forms the forward expanse of sail in the direction of travel and the expanse of sail 5 the aft expanse of sail in the direction of travel. Where they are visible, the expanses of sail 4, 5 are shown in solid lines in FIG. 1.

In the embodiment of the invention which is shown in FIG. 1, there are two masts each having two expanses of sail for a total of four expanses of sail.

To allow the expanses of sail 4, 5 to be held and set, the mast 3 has an upper mounting 7 at its upper end 6 which points away from vessel 2. At its lower end 10 which is connected to vessel 2, mast 3 also has a lower mounting 11. Ends 12, 13; 14, 15 of the expanses of sail 4, 5 are guided on the mountings 7, 11 to be adjustable in the longitudinal direction 16 and transverse direction 17 of the vessel 2. This is indicated in FIG. 1 by double-headed arrows A, B.

As indicated in FIG. 1, the mountings 7, 11 are each of a cruciform shape. To guide the relevant ends 12 to 15 of the expanses of sail 4, 5, each mounting 7, 11 has a support 20, hereinafter referred to as a longitudinal support, which extends in the longitudinal direction 16 of the vessel 2, and a support 21, hereinafter referred to as a transverse support, which extends in the transverse direction 17 of the vessel 2. In FIG. 1, the longitudinal and transverse supports 20, 21 make an angle of 90° with one another.

Each longitudinal support 20, i.e., the longitudinal support 20 of the upper mounting 7 and the longitudinal support 20 of the lower mounting 11, has a bow portion 22 and a stern portion 23. What is more, each transverse support 21, i.e. the transverse support 21 of the upper mounting 7 and the transverse support 21 of the lower mounting 11, has a port portion 24 and a starboard portion 25, to receive respective ends 12, 13; 14, 15 of one of the expanses of sail 4, 5. The portions of the supports may be of equal lengths.

As indicated in FIG. 1, the forward end 12 of one expanse of sail 4, this being the forward expanse of sail, is fastened to the longitudinal supports 20 of the mountings 7, 11, preferably in such a way as to be adjustable independently at the two points. The aft end 13 of this expanse of sail 4 is also fastened preferably in such a way as to be adjustable independently at the two points, in this case to the transverse supports 21 of the mountings 7, 11. What applies to the expanse of sail 5, this being the aft expanse of sail in the direction of travel, is that the forward end 14 is fastened to the transverse supports 21 of the mountings 7, 11, and the aft end 15 is fastened to the longitudinal supports 20 of the mountings 7, 11, once again preferably in such a way to be adjustable independently at the two points. In a preferred further embodiment of the invention, each of the ends 12, 13; 14, 15 of the expanses of sail 4, 5 can be positioned separately from the others on the upper and lower mountings 7, 11 to enable the given expanse of sail to be differently adjusted at the top and bottom to position it in the optimum way over its height.

In a preferred embodiment of the invention, the mountings 7, 11, and preferably the mast 3 plus the mountings 7, 11 it has, are rotatable, as is indicated in FIG. 1 by the double-headed arrow C. It is also possible for the mountings or the mast plus the mountings to be designed to be rotatable through only 90°. In relation to the arrangement shown in FIG. 1, this would mean for example that the end-points I, II, III, IV of the mounting 7, 11 can be rotated through 90° clockwise and, from this latter position, can be rotated through 90° counter-clockwise back to the original position shown in FIG. 1. When rotated through 90° clockwise, point IV in FIG. 1 would then be situated at the position in which point I is shown in FIG. 1. The same applies, mutatis mutandis, to the other end-points.

In a further embodiment of the invention, the mountings 7, II are also able to be turned relative to one another.

In another preferred embodiment of the invention, the longitudinal and transverse supports 20, 21 of the mountings 7, 11 are rails in profile form. Each longitudinal and transverse support 20, 21 has two rails in profile form (not shown) extending parallel to one another which extend for the full length of the longitudinal or transverse support, i.e., over both portions 22, 23; 24, 25. In the case of this latter embodiment, it is not necessary for the mountings or the mast plus the mountings it has to be rotated in order to maneuver the vessel. The vessel is able to perform all sailing maneuvers such as tacking and wearing.

The expanses of sail 4, 5 take the form of rectangular or trapezoidal sails which are arranged vertically, i.e., parallel to the mast 3. This is illustrated by the expanses of sail in FIG. 1, which take the form of rectangular sails.

In an embodiment of the invention which is a particular preference, the setting, adjustment and taking-in of the expanses of sail 4, 5 is microprocessor controlled (not shown).

FIG. 1 shows that the expanse of sail 4 is associated with the lee side 26 of the vessel 2 and the other expanse of sail 5 is associated with the windward side 27 thereof. It can also be seen that the forward end 12 of the expanse of sail 4 is displaceable at the end-points I in the directions indicated by the double-headed arrow A whereas the aft end 13 of the expanse of sail 4 is displaceable at the end-points 30 in the directions indicated by the double-headed arrow B. The reverse is true of the expanse of sail 5, in that its forward end 14 is guided to be adjustable at the end-points 31 in the directions indicated by the double-headed arrow B whereas the end-points III of the aft end 15 are guided to be adjustable in the directions indicated by the double-headed arrow A.

Selected positions of the expanses of sail 4, 5 are shown by way of example in FIGS. 2 to 7 in respective purely schematic plan views. The direction of the wind is indicated by an arrow D in all the Figures.

Figure 2:
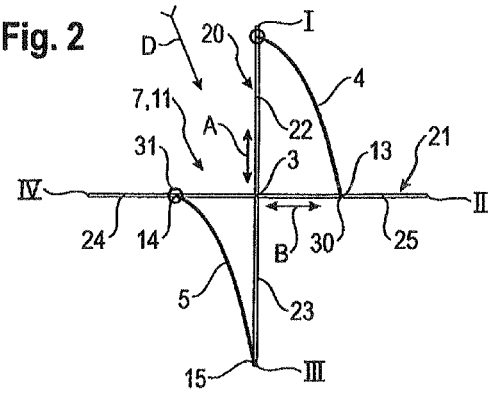
FIG. 2 is a schematic plan view of part of the sail system when the wind is blowing from port and the sails are in the "close to the wind" position.
Figure 3:
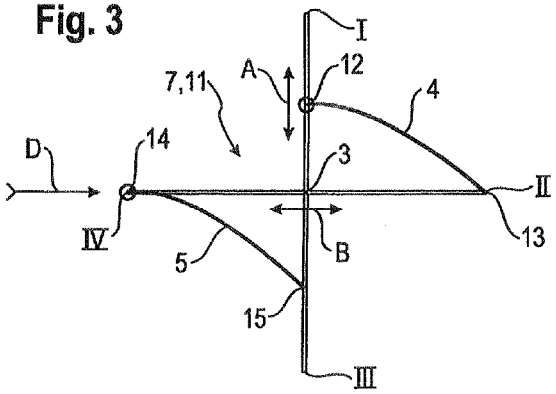
FIG. 3 is a schematic plan view of part of the sail system when the wind is blowing from port and the sails are in the "on a beam reach" position.
Figure 4:
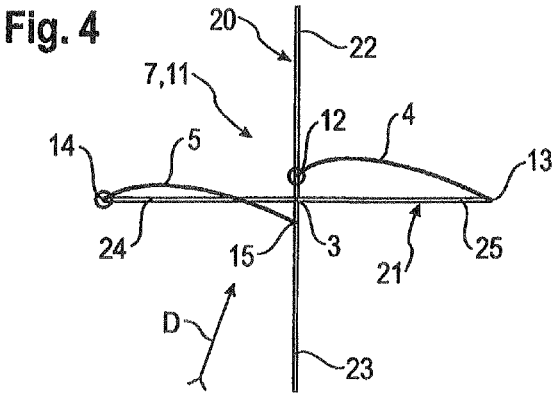
FIG. 4 is a schematic plan view of part of the sail system when the wind is blowing from port and the sails are in the "on a broad reach" position.

FIG. 2 shows the "close to the wind" position of the sails when the wind is blowing from port, FIG. 3 shows the "on a beam reach" position of the sails when the wind is blowing from port, and FIG. 4 shows the "on a broad reach" position of the sails with a wind from the port side.

Figure 5:
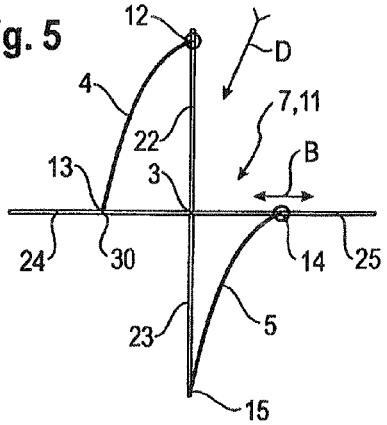
FIG. 5 is a schematic plan view of part of the sail system when the wind is blowing from starboard and the sails are in the "close to the wind" position.
Figure 6:
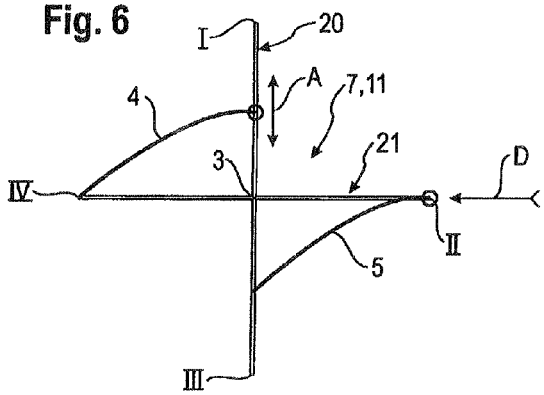
FIG. 6 is a schematic plan view of part of the sail system when the wind is blowing from starboard and the sails are in the "on a beam reach" position.
Figure 7:
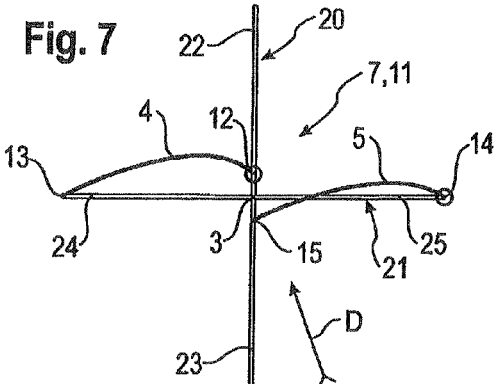
FIG. 7 is a schematic plan view of part of the sail system when the wind is blowing from starboard and the sails are in the "on a broad reach" position.

FIG. 5 shows the "close to the wind" position of the sails with the wind from the starboard side, FIG. 6 shows the appropriate position of the sails for "on a beam reach," and FIG. 7 shows the appropriate position of the sails for "on a broad reach".

In the positions of the sails which are shown in FIGS. 2 to 4, the prevailing wind is, as mentioned above, from the port side. To change the position of the sails from that shown in FIG. 2 to that shown in FIG. 3, the forward end 12 of the expanse of sail 4 is moved inwards towards the mast 3 and the aft end 13 of the expanse of sail 4 is moved outwards to the end-point II, thus producing, in the end, the "on a beam reach, wind from port" position of the sails which is shown in FIG. 3. To match this, what applies to expanse of sail 5 is movement of the end-point 31 at the forward end 14 outwards in the direction of the end-point IV and movement of the aft end 15 in the direction of the mast 3.

After a tacking or wearing following this, the "close to the wind," "on a beam reach," and "on a broad reach" positions which are shown in FIGS. 5 to 7 arise, the wind then blowing from starboard in each case. As mentioned above, the sail system according to the invention can be rotated through 90° for this purpose as indicated by the double-headed arrow C on the left of FIG. 5. In this case, when there is a tacking turn, the port portion 24 of the transverse support 21 in FIG. 2 becomes the bow portion 22 of the longitudinal support 20 in the position shown in FIG. 5. In the same way, the bow portion 22 of the longitudinal support in FIG. 2 becomes the starboard portion 25 of the transverse support 21 in the position shown in FIG. 5. The same is true, mutatis mutandis, of the starboard portion 25 of the transverse support in FIG. 2 which then becomes the stern portion 23 of the longitudinal support in the position shown in FIG. 5, and of the stern portion 23 of the longitudinal support in FIG. 2, which becomes the port portion 24 of the transverse support 21 in the position shown in FIG. 5.

In a preferred refinement of the invention, transfer of the expanses of sail from, for example, the position shown in FIG. 2 to that shown in FIG. 5 is also possible by transferring the aft end 13 of the expanse of sail 4 from the starboard portion 25 of the transverse support 21 (see the position shown in FIG. 2) to the port portion 24 thereof (see the position shown in FIG. 5). At the same time, the forward end 14 of the aft expanse of sail 5, in the position shown in FIG. 2, is then transferred to the right, i.e., from the port portion 24 of the transverse support 21 to the starboard portion 25 thereof. In the latter case, the mountings, and preferably the mast plus the mountings it has, thus do not need to be designed to be rotatable. What has been said also applies in a similar way to a transfer of the expanses of sail by means of a wearing maneuver from for example the position shown in FIG. 4 to that shown in FIG. 7. In this case the aft expanse of sail 5 in FIG. 4 then becomes the forward expanse of sail 4 in FIG. 7 and the forward expanse of sail 4 in FIG. 4 becomes the aft expanse of sail 5 in FIG. 7.

Therefore, in accordance with the invention, the forward end 12 is displaceable in the longitudinal direction 16 of the vessel 2 in the case of the forward expanse of sail 4 and the aft end 13 of this expanse of sail is displaceable in the transverse direction 17 of the vessel 2, in the two mountings 7, 11. What applies in the case of the second, aft, expanse of sail 5 is that the forward end 14 is movable, and in particular displaceable, in the transverse direction 17 of the vessel 2 and the aft end 15 is movable, and in particular displaceable, in the longitudinal direction 16 of the vessel 2, in each of the mountings 7, 11. The forward ends 12, 14 of the expanses of sail 4, 5 may take the form of rolling forestays and the aft ends 13, 15 of the expanses of sail 4, 5 may be formed to have an after-leech rope. It is clear that the said ends 12 to 15 may be moved individually, i.e. independently of one another, meaning that the sail profiles may be positioned to curvatures of different magnitudes. It may be possible, as mentioned above, for the expanses of sail 4, 5 to be reefed by means of their respectively rolling forestays; however it is also conceivable for provision to be made for them to be reefed in the downward direction, i.e., towards the vessel.

The four end-points I to IV of each mounting 7, 11 are usually connected together vertically by cross-members 32. For greater clarity, only some of the said cross-members 32 have been shown in FIG. 1. It is clear that the bending of the mast is reduced by the fitting of the cross-members. The mountings 7, 11 may take the form of a turntable and may be connected to the hull of the vessel 2. By moving the respective aft ends 13, 15 of the expanses of sail 4, 5, i.e., by moving the respective after-leeches, in synchronization or even in different ways in respect of the upper mounting 7 and lower mounting 11, the sail system can be set positioned to different profiles and to profiles of different depths. Different profiles and a so-called twist can also be combined with one another.

As mentioned above, the sail system in accordance with the invention has at least one mast. It is clear that, as shown in FIG. 1, it is also possible for a plurality of such masts forming part of the rigging to be arranged one behind the other. There are usually two identical expanses of sail, which can be trimmed in a variety of ways, on each mast.

As mentioned above, there is one mounting, also referred to as a frame, at the top of the mast and one further mounting above the deck of the vessel. What are used as materials for the mast and the mountings are preferably materials which are light but at the same time of high strength from the fields of aeronautics and space travel, preferably with due consideration of the latest findings in bionics. The expanses of sail may be concave and outwardly curved and may be held fixed laterally on both sides, semi-rigidly or flexibly, with or without sail battens, to the upper and lower mountings by steel cables. The said expanses of sail are, as explained above, able to be displaced towards one another, for example by changing the mast/mounting geometry from a square shape towards a diamond shape similar to that of a parallelogram. The sail system according to the invention may be used as a main means of propulsion for the vessel or as an additional means of propulsion.

A sail system has thus been provided which enables particularly efficient use to be made of the energy of the wind and which in particular makes it possible to sail close to the wind.

While the present invention has been particularly described, in conjunction with the specific preferred embodiment(s), it is evident that many alternatives, modifications, and variations will be apparent to those skilled in the art, in light of the foregoing description. It is therefore contemplated that the appended claims will embrace any such alternatives, modifications, and variations as falling within the true scope and spirit of the present invention.

Thus, having described the invention, what is claimed is:

1. A sail system for a deep-sea vessel comprising at least one mast which is connected to the vessel and including two expanses of sail held by said at least one mast, said at least one mast including an upper mounting at its upper end pointing away from the vessel, and a lower mounting at its lower end connected to the vessel, to enable said expanses of sail to be held and set, and ends of the expanses of sail displaceably guided in the mountings in the longitudinal and transverse directions of the vessel, wherein the mountings include a cruciform shape and a support extending in the longitudinal direction of the vessel and a support extending in the transverse direction of the vessel, to guide the ends of the expanses of sail, including having a forward end of one expanse of sail fastened to the longitudinal supports of the mountings and an aft end of this one expanse of sail fastened to the transverse supports thereof, and a forward end of the other expanse of sail fastened to the transverse supports of the mountings and an aft end of this other expanse of sail fastening to the longitudinal supports thereof, adjustable independently of one another, and each end of the expanses of sail positionable separately from the others on the upper and lower mountings.

2. The sail system of claim 1, wherein each longitudinal support includes a bow and a stern portion and each transverse support includes a port and a starboard portion, to receive respective ends of one of the expanses of sail.

3. The sail system of claim 1, including having the mountings or the mast plus the mountings rotatable.

4. The sail system of claim 1, wherein the mountings are turnable relative to one another.

5. The sail system of claim 1, wherein the longitudinal and transverse supports of the mountings include rails in profile form and each longitudinal and transverse support includes two rails in profile form extending approximately parallel to one another, both of which extend for the entire length of the longitudinal and transverse supports.

6. The sail system of claim 1, wherein the expanses of sail form rectangular or trapezoidal sails arranged parallel to the mast.

7. The sail system of claim 1 comprising a microprocessor for controlling the setting and adjustment of the expanses of sail.

8. The sail system of claim 2, including having the mountings, or the mast plus the mountings, rotatable.

9. The sail system of claim 2, wherein the mountings are turnable relative to one another.

10. The sail system of claim 3, wherein the mountings are turnable relative to one another.

11. The sail system of claim 2, wherein the longitudinal and transverse supports of the mountings include rails in profile form and each longitudinal and transverse support includes two rails in profile form extending approximately parallel to one another, both of which extend for the entire length of the longitudinal and transverse supports.

12. The sail system of claim 10, wherein the longitudinal and transverse supports of the mountings include rails in profile form and each longitudinal and transverse support includes two rails in profile form extending approximately parallel to one another, both of which extend for the entire length of the longitudinal and transverse supports.

13. The sail system of claim 1, wherein the expanses of sail form rectangular or trapezoidal sails arranged parallel to the mast.

14. The sail system of claim 12, wherein the expanses of sail form rectangular or trapezoidal sails arranged parallel to the mast.

15. The sail system of claim 2 comprising a microprocessor for controlling the setting and adjustment of the expanses of sail.

16. The sail system of claim 1 comprising a microprocessor for controlling the setting and adjustment of the expanses of sail.

17. The sail system of claim 12 comprising a microprocessor for controlling the setting and adjustment of the expanses of sail.

* * * * *